US008081872B2

(12) United States Patent
Wang

(10) Patent No.: US 8,081,872 B2
(45) Date of Patent: Dec. 20, 2011

(54) FLAME IMITATION MANUFACTURING DEVICE OF AN ELECTRICAL-HEATED FIREPLACE

(75) Inventor: Zhuhong Wang, Chongzhou (CN)

(73) Assignee: Zhuhong Wang (CN)

( * ) Notice: Subject to any disclaimer, the term of this patent is extended or adjusted under 35 U.S.C. 154(b) by 759 days.

(21) Appl. No.: 11/996,086

(22) PCT Filed: Aug. 18, 2005

(86) PCT No.: PCT/CN2005/001290
§ 371 (c)(1),
(2), (4) Date: May 15, 2008

(87) PCT Pub. No.: WO2007/009301
PCT Pub. Date: Jan. 25, 2007

(65) Prior Publication Data

US 2008/0226267 A1 Sep. 18, 2008

(30) Foreign Application Priority Data

Jul. 18, 2005 (CN) ..... 2005 2 0034862 U

(51) Int. Cl.
*F24B 1/18* (2006.01)

(52) U.S. Cl. ..... 392/348; 392/347; 392/350

(58) Field of Classification Search ..... 392/348, 392/347, 350
See application file for complete search history.

(56) References Cited

U.S. PATENT DOCUMENTS

| | | | | |
|---|---|---|---|---|
| 2,474,472 | A * | 6/1949 | Doyle | 392/348 |
| 3,395,475 | A * | 8/1968 | Moss | 40/428 |
| 3,603,013 | A * | 9/1971 | Reed et al. | 40/428 |
| 4,965,707 | A | 10/1990 | Butterfield | |
| 6,944,982 | B2 * | 9/2005 | Schroeter et al. | 40/428 |
| 7,080,472 | B2 * | 7/2006 | Schroeter et al. | 40/428 |
| 2005/0086841 | A1 * | 4/2005 | Schroeter et al. | 40/428 |
| 2009/0126241 | A1 * | 5/2009 | Asofsky | 40/428 |

FOREIGN PATENT DOCUMENTS

| | | | |
|---|---|---|---|
| CN | 1463346 | A | 12/2003 |
| GB | 2331356 | A | 5/1999 |
| GB | 2350182 | A | 11/2000 |
| JP | 9-112922 | A | 5/1997 |

* cited by examiner

*Primary Examiner* — Thor Campbell
(74) *Attorney, Agent, or Firm* — Banner & Witcoff, Ltd.

(57) ABSTRACT

A flame imitation manufacturing device of a fireplace relates to a flame imitation manufacturing device for simulating the burning state in a fireplace in the field of household appliances. Said device comprises a housing, a cross flow fan and a light source mounted on a base plate of the housing, a simulated fire chamber mounted on a back plate of the housing, ribbons mounted on the back plate of the housing by means of upper and lower strip bars and above the cross flow fan, and a light-transmitting glass plate mounted on the housing and in front of said ribbons. This invention, characterized in that said cross flow fan is a swinging one, is advantageous in that supplying wind non-directively by utilizing the swinging of said fan improves the flying state of ribbons so as to make the image state of burning flames more vivid, greatly enhances the authenticity of flames and lowers the cost thereof, and thus is adaptable to various flame imitation electrical-heated fireplaces and electrical appliances.

6 Claims, 2 Drawing Sheets

A-Side

FLAME IMITATION MANUFACTURING DEVICE OF AN ELECTRICAL-HEATED FIREPLACE

TECHNICAL FIELD

This invention relates to a heating device in the field of household electrical appliances, particularly to a flame imitation manufacturing device for simulating fired states in a fireplace.

BACKGROUND ART

A Chinese utility model No. 99247747.6 has disclosed an electrical-heated decorating fireplace comprising a cast-iron housing, an electrical-heated pipe disposed within the housing, a circuit section, and a flame imitation device. Said flame imitation device of a fireplace comprises organic glasses, simple glasses, reflective films, flame imitation ribbons, electrical bulbs and a cross flow fan. Said device has the following shortcomings: the direction of wind blasted to ribbons by the cross flow fan which is fixed on a base plate of the housing is stationary, the flying intensity of ribbons is consequently unchanged, which results in slight change, low fidelity and insufficient authenticity in the general contour of flame images of ribbons. The electrical-heated fireplace disclosed in a British invention No. GB2350182 and the simulated electrical-heated fireplace disclosed in a Chinese invention No. ZL03232928.8 also have the above mentioned shortcomings.

SUMMARY OF THE INVENTION

The object of this invention is to overcome the above shortcomings in the prior art by providing a flame imitation manufacturing device with flame images higher in fidelity and stronger in authenticity.

The flame imitation manufacturing device of this invention comprises a housing, a cross flow fan and a light source mounted on a base plate of said housing, a simulated fire chamber mounted on a back plate of the housing, ribbons mounted on the back plate of the housing by means of upper and lower strip bars and above the cross flow fan, a light-transmitting glass plate mounted on the housing and in front of the ribbons. This invention is characterized in that said cross flow fan, a swinging one, may comprise a hinge post fixed on the base plate of the housing, a fan itself mounted on the hinge post, a guide recess gasket fixed on one end of the fan, a drive motor mounted on the housing, a turnplate fixed on a rotating shaft of the drive motor, and a transmission rod with one end fixed on the edge of the turnplate and the other end extending into the recess of said guide recess gasket. Also, said cross flow fan may comprise a hinge post fixed on a base plate of the housing, a fan itself mounted on said hinge post, an eccentric gear fixed on a motor shaft of said fan, a baffle plate corresponding to said eccentric gear and fixed on said housing, and a return spring mounted between said housing and said fan. The swinging of said fan may be realized in other manners as well. The light source casts light on the flame imitation fire chamber and the ribbons during operation, ribbons are blasted to fly up and down and axially as well due to wind supplied by the swinging fan. The flying extent and intensity of ribbons vary consequently caused by varying wind intensity. Light reflected from the flame imitation fire chamber and ribbons is filtered into the visual field through the light-transmitting glass plate to form dynamic flame images. Besides flickering up and down, said flame-like images are also characterized in the following: the flame images vary much more greatly in height as flames at two ends are sometimes present and sometimes not present, which makes the image state of burning flames closer to real flames, more vivid and stronger in authenticity.

That designing said lower strip bar for mounting ribbons to be wave-like changes the flat and vertical cooperation of ribbons, improves the reflective surface of ribbons from a plane to a cambered surface with richer reflective angles, meanwhile enhances the longitudinal-axially reversing of ribbons, and improves the extent of variation of flame images as well.

Said ribbons may be alternately configured with golden ones and argent ones. Ribbons in such a configuration are capable to simulate burning flames with the heart thereof being dazzling white which is more close to the real color of the burning flames.

Compared with previously mentioned products belonging to the same category, this invention is advantageous in that supplying wind by utilizing the swinging of said fan improves the flying state of ribbons so as to make the image state of burning flames more vivid, greatly enhances the authenticity of flames, and thus is adaptable to various flame imitation appliances.

The contents of this invention will be further illustrated with reference to the following embodiments, but not limited only to the contents related to thereby.

DESCRIPTION OF THE PREFERRED EMBODIMENTS

Embodiment 1

Figure 1:
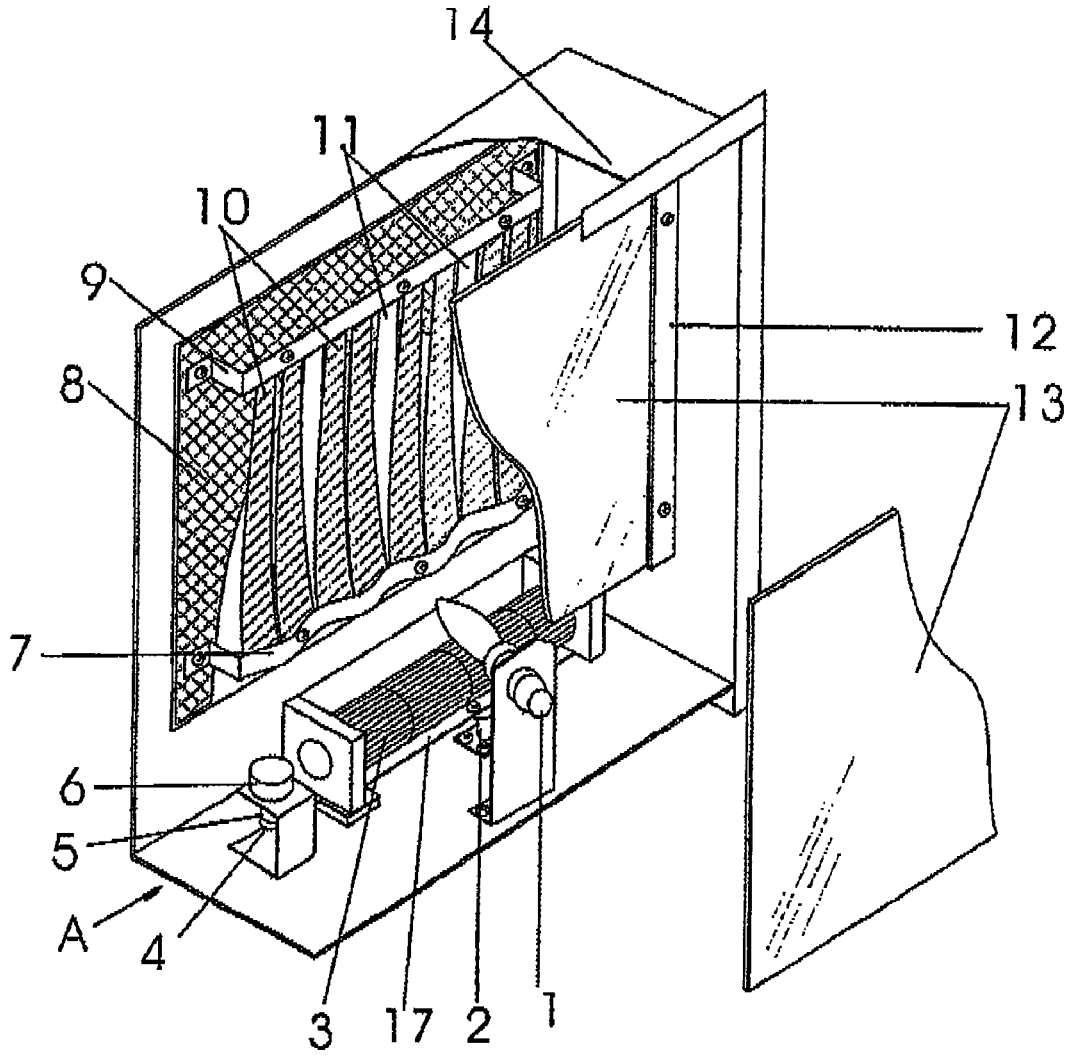
FIG. 1 is a schematic illustration of the structures of this invention.
Figure 2:
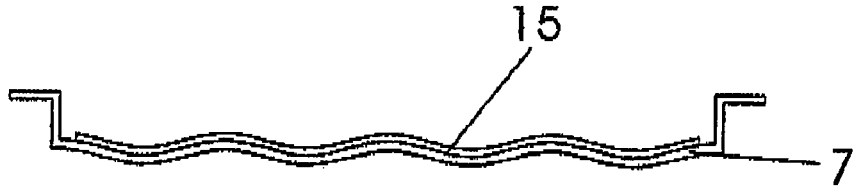
FIG. 2 is a schematic illustration of structure of the wave-like lower strip bar.
Figure 3:
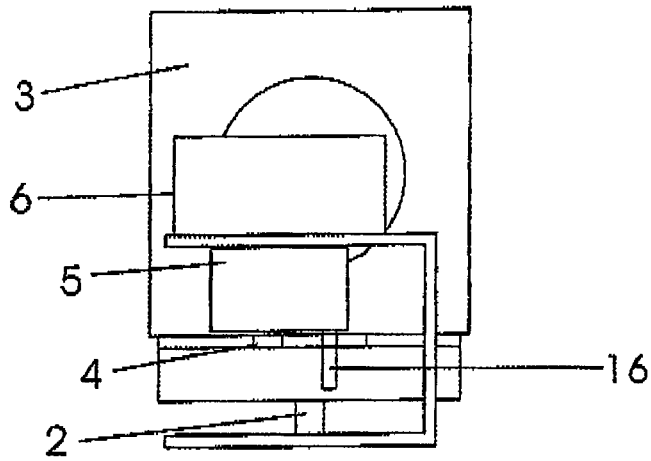
FIG. 3 is an A-side enlarged view of FIG. 1.
Figure 4:
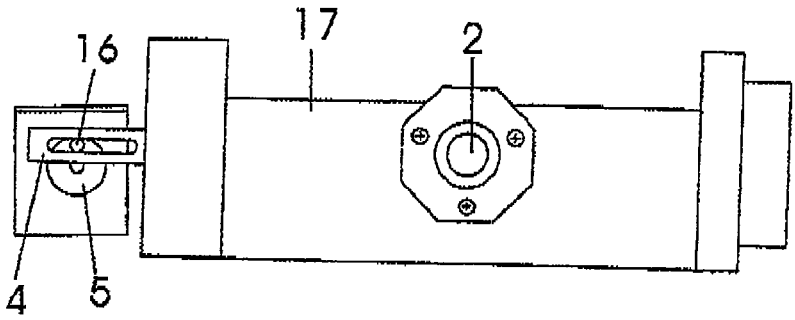
FIG. 4 is an upward enlarged view of the swinging cross flow fan in FIG. 1.

As shown in FIGS. 1-4, in this embodiment the swinging cross flow fan comprises a hinge post 2 fixed on a base plate of a housing 14, a fan itself 3 mounted on said hinge post 2, a guide recess gasket 4 fixed on one end of said fan, a drive motor 6 mounted on said housing, a transmission gear 5 fixed on a rotating shaft of said drive motor 6, and a transmission rod 16 with one end offset from said rotating shaft of the motor and fixed on the transmission gear 5 and the other end extending into the recess of said guide recess gasket 4. The rotation of the motor 6 brings the transmission rod 16 to drive the guide recess gasket 4 and thereby to drive the cross flow fan to swing. A light source 1 is fixed on the base plate of the housing 14. Ribbons which are configured alternately with golden ribbons 10 and argent ribbons 11 are mounted on a back plate of the housing and above the cross flow fan by means of an upper strip bar 9 and a lower strip bar 7, A light-transmitting glass plate 13 is mounted on the housing and in front of the ribbons; the lower strip bar 7 is wave-like. In the drawings, "15" indicates a fixed bar, "12" indicates a fixed mount for mounting the light-transmitting glass plate 13, "17" indicates the base plate of said fan, via which the fan itself is mounted on the hinge post 2.

Similar to this embodiment, the structure that drives the cross flow fan to swing is to directly design the transmission gear which is fixed on the motor shaft to be in a shape of an eccentric gear which is extended into the guide recess gasket so as to drive the cross flow fan to swing.

Embodiment 2

Figure 5:
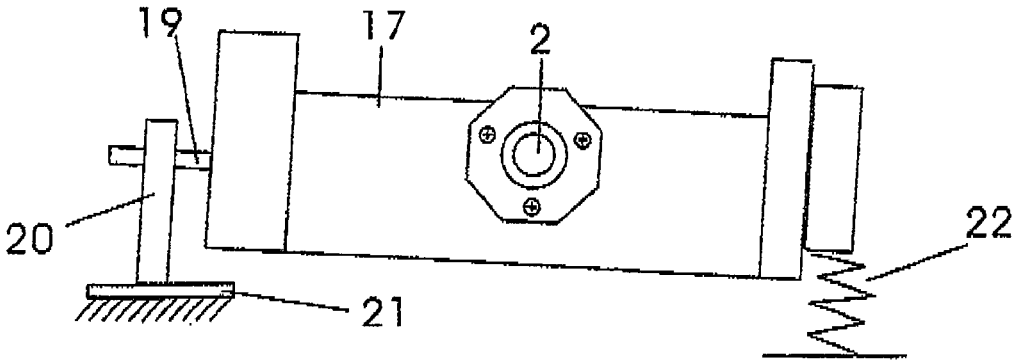
FIG. 5 is a schematic illustration of the structure of another swinging cross flow fan.

Referring to FIG. 5, this embodiment differs the previous embodiment in that: an eccentric gear 20 is fixed on a motor shaft 19 of the fan itself, a baffle plate 21 is fixedly mounted on a position of the housing corresponding to the eccentric gear, a return spring 22 is mounted between the housing and the fan. The rotation of the motor drives the rotation of the eccentric gear 20, the fan swings around a hinge post 2 under the influence of the baffle plate 21 and returns to the original position by means of the return spring 22. The rotating speed of the eccentric gear may be adjusted by utilizing a variable speed mechanism.

The invention claimed is:

1. A flame imitation manufacturing device of an electrical-heated fireplace, comprising a housing, a cross flow fan, and a light source mounted on a base plate of said housing, a simulated fire chamber mounted on a back plate of said housing, ribbons mounted on the back plate of the housing by means of upper and lower strip bars and above the cross flow fan, and a light-transmitting glass plate mounted on the housing and in front of the ribbons, wherein said cross flow fan is a swinging one; and wherein said swinging cross flow fan comprises a hinge post fixed on the base plate of said housing, a fan itself mounted on the hinge post, a guide recess gasket fixed on one end of the fan, a drive motor mounted on the housing, a transmission gear fixed on a rotating shaft of the drive motor, and a transmission rod with one end offset from the rotating shaft of the motor and mounted on the transmission gear and another end extending into the guide recess gasket.

2. The flame imitation manufacturing device according to claim 1, wherein said lower strip bar for mounting ribbons is a wave-like lower strip bar.

3. The flame imitation manufacturing device according to claim 1, wherein said ribbons are alternately configured with golden ribbons and argent ribbons.

4. The flame imitation manufacturing device of an electrical-heated fireplace, comprising a housing, a cross flow fan and a light source mounted on a base plate of said housing, a simulated fire chamber mounted on a back plate of said housing, ribbons mounted on the back plate of the housing by means of upper and lower strip bars and above the cross flow fan, and a light-transmitting glass plate mounted on the housing and in front of the ribbons, wherein said cross flow fan is a swinging one; and wherein said swinging cross flow fan comprises a hinge post fixed on the base plate of said housing, a fan itself mounted on the hinge post, an eccentric gear fixed on the motor shaft of the fan, a baffle plate corresponding to said eccentric gear and mounted on the housing, and a return spring mounted between said housing and said fan.

5. The flame imitation manufacturing device according to claim 4, wherein said lower strip bar for mounting ribbons is a wave-like lower strip bar.

6. The flame imitation manufacturing device according to claim 5, wherein said ribbons are alternately configured with golden ribbons and argent ribbons.

* * * * *